US012576318B2

(12) United States Patent
Roll

(10) Patent No.: US 12,576,318 B2
(45) Date of Patent: Mar. 17, 2026

(54) TOWEL WITH INTEGRATED BRUSH

(71) Applicant: ROBERT RYAN GOLF LLC, Blackfoot, ID (US)

(72) Inventor: Robert Ryan Roll, Blackfoot, ID (US)

(73) Assignee: ROBERT RYAN GOLF LLC, Blackfoot, ID (US)

( * ) Notice: Subject to any disclaimer, the term of this patent is extended or adjusted under 35 U.S.C. 154(b) by 346 days.

(21) Appl. No.: 18/249,506

(22) PCT Filed: Oct. 19, 2021

(86) PCT No.: PCT/US2021/055624

§ 371 (c)(1),
(2) Date: Apr. 18, 2023

(87) PCT Pub. No.: WO2022/086971

PCT Pub. Date: Apr. 28, 2022

(65) Prior Publication Data

US 2023/0381608 A1 Nov. 30, 2023

Related U.S. Application Data

(60) Provisional application No. 63/198,443, filed on Oct. 19, 2020.

(51) Int. Cl.

| | |
|---|---|
| ***A63B 57/60*** | (2015.01) |
| ***A46B 15/00*** | (2006.01) |
| ***A63B 47/04*** | (2006.01) |

(52) U.S. Cl.

CPC ..... *A63B 57/60* (2015.10); *A46B 15/0055* (2013.01); *A63B 47/04* (2013.01); *A46B 2200/3073* (2013.01)

(58) Field of Classification Search

CPC ..... A47L 13/12; A47L 13/10; A47L 13/16; A47K 10/02; A63B 57/60

See application file for complete search history.

(56) References Cited

U.S. PATENT DOCUMENTS

| | | | |
|---|---|---|---|
| 1,031,586 | A | 7/1912 | Reinstein |
| 5,797,142 | A | 8/1998 | Debronsky, Jr et al. |
| 9,162,125 | B1 | 10/2015 | McBryde |
| 2015/0096136 | A1 | 4/2015 | McKee |

FOREIGN PATENT DOCUMENTS

| | | | |
|---|---|---|---|
| WO | 2022086971 | A1 | 4/2022 |

OTHER PUBLICATIONS

Preliminary Report on Patentability for International Application No. PCT/US2021/055624, dated May 4, 2023, 9 pages.

International Search Report and Written Opinion for International Application No. PCT/US2021/055624, dated Dec. 28, 2021, 14 pages.

*Primary Examiner* — Shay Karls

(74) *Attorney, Agent, or Firm* — Ryan L. Marshall; Steven Sturlis; Barnes & Thornburg LLP

(57) ABSTRACT

The present disclosure relates to an apparatus for cleaning equipment, such as golf clubs, golf balls, or cleats. The apparatus includes a towel and an integrated brush having bristles, wherein the integrated brush is durably attached to the towel along an edge of the towel, and the bristles extend away from the edge of the towel. The apparatus offers many benefits, including the ability to clean articles more quickly and efficiently, as well as providing convenience to users by combining multiple cleaning implements into a single apparatus. Also disclosed are methods of cleaning equipment with the apparatus described herein.

22 Claims, 4 Drawing Sheets

20
20
20
20
24
24
24
28
22
22
22
34
34
32
30

TOWEL WITH INTEGRATED BRUSH

RELATED APPLICATIONS

This application is a National Stage application of International Application No. PCT/US2021/055624 filed 19 Oct. 2021, which claims the benefit under 35 U.S.C. 119 (e) of U.S. Provisional Patent Application Ser. No. 63/198,443 filed 19 Oct. 2020, herein incorporated by reference in its entirety.

TECHNICAL FIELD

The present disclosure relates to an apparatus for cleaning sports equipment, such as golf clubs, golf balls, or cleats, where the apparatus is a towel with an integrated brush. The present disclosure additionally relates to a method of using a towel with an integrated brush to clean equipment.

BACKGROUND

Keeping one's sports equipment clean is critical for ensuring the proper performance of the equipment, for example when playing golf, as well as for promoting the overall longevity of the equipment. Athletes, therefore, carry multiple implements for cleaning their equipment, including towels and brushes. The combination of these cleaning implements into a single apparatus would allow an athlete to clean their equipment more rapidly and with less effort, while reducing the amount of equipment the athlete is required to carry.

SUMMARY OF THE DISCLOSURE

The present disclosure relates to an apparatus, also referred to as a brush towel, for cleaning sports equipment. The brush towel includes a towel and an integrated brush having bristles, wherein the integrated brush is durably attached to the towel along an edge of the towel, and the bristles extend laterally away from the edge of the towel.

In one embodiment, the brush towel includes a towel and an integrated brush having bristles, wherein the integrated brush is durably attached to the towel along an edge of the towel, the bristles extend away from the edge of the towel within a plane defined by the towel, and the integrated brush is configured to be foldable around a transverse axis that runs through the towel, wherein the transverse axis is perpendicular to the integrated brush.

Also disclosed herein is a method of cleaning an article of sports equipment with the brush towel described herein. In one embodiment, the method includes folding the integrated brush around a transverse axis that runs through the towel, wherein the transverse axis is perpendicular to the integrated brush, and scrubbing the article of sports equipment with the integrated brush.

The brush towel offers many benefits, including the ability to clean articles of sports equipment more quickly and efficiently, as well as providing convenience to athletes by combining multiple cleaning implements into a single article or apparatus.

DETAILED DESCRIPTION

With reference to the drawings, in particular FIGS. 1 through 8, an example of an apparatus, also referred to as a brush towel, will be described, as well as the general concepts and principles that underlie the innovation disclosed herein. It should be appreciated that the examples and drawings provided herewith are intended only to illustrate the inventive concepts disclosed herein and are not necessarily drawn to scale or intended to limit the scope of the present invention.

Referring to FIGS. 1 through 8, a brush towel 10 for cleaning sports equipment is illustrated and described. The brush towel 10 includes a towel 20 and an integrated brush 22 having bristles. The integrated brush 22 is durably attached to the towel 20 along an edge of the towel, wherein the bristles extend away from the edge of the towel. In some embodiments, the bristles extend away from the edge of the towel within a plane defined by the body of the towel 20. In some embodiments, the integrated brush 22 is durably attached to the towel 20 along an edge of the towel, such that the integrated brush 22 defines at least a portion of at least one side of the towel 20, as shown in FIGS. 1 through 8.

The brush towel offers many benefits, including the ability to clean equipment more quickly and efficiently, as well as providing convenience to athletes by combining multiple cleaning implements into a single apparatus.

For example, the brush towel is useful for cleaning a golf club, wherein the bristles of the integrated brush are used to clean the grooves on the face of any golf club. The integrated brush may be folded, such that the surface area of the golf club in contact with the integrated brush is increased, allowing the golfer to apply force more directly to the face of the golf club during cleaning. The towel is then used to remove any remaining debris from the head of the golf club.

Furthermore, the brush towel provides convenience by combining multiple cleaning implements into a single apparatus. For example, many golfers carry both a small brush and a towel to clean club heads while on the golf course. The brush towel combines these disparate implements into a single apparatus, thereby reducing the number of individual tools that a golfer is required to carry on the course.

Figure 1:
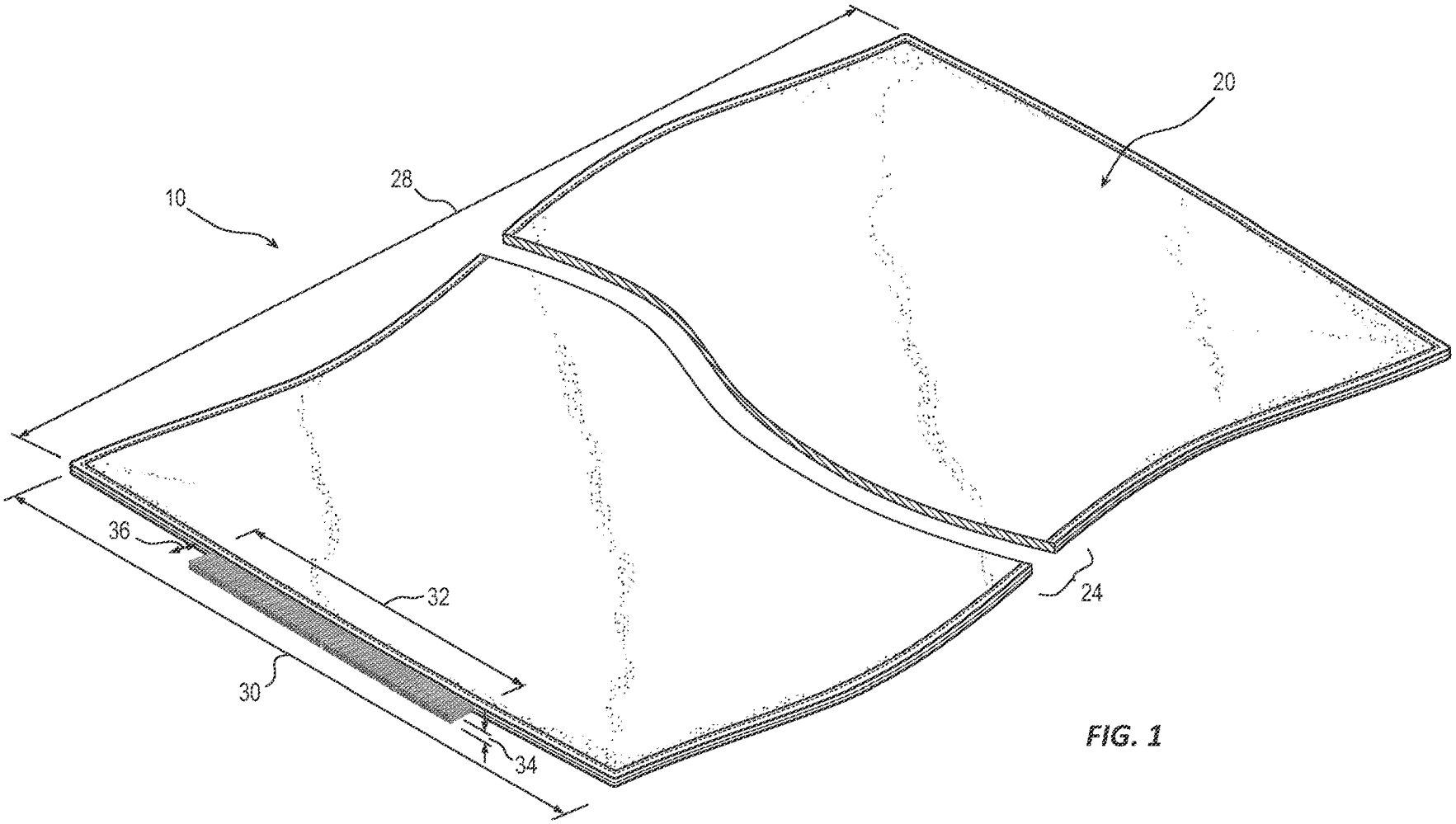
FIG. 1 is a right-front perspective view of the brush towel, showing that the towel is flexible in nature.
Figures 2, 3, 4, 5, 6:
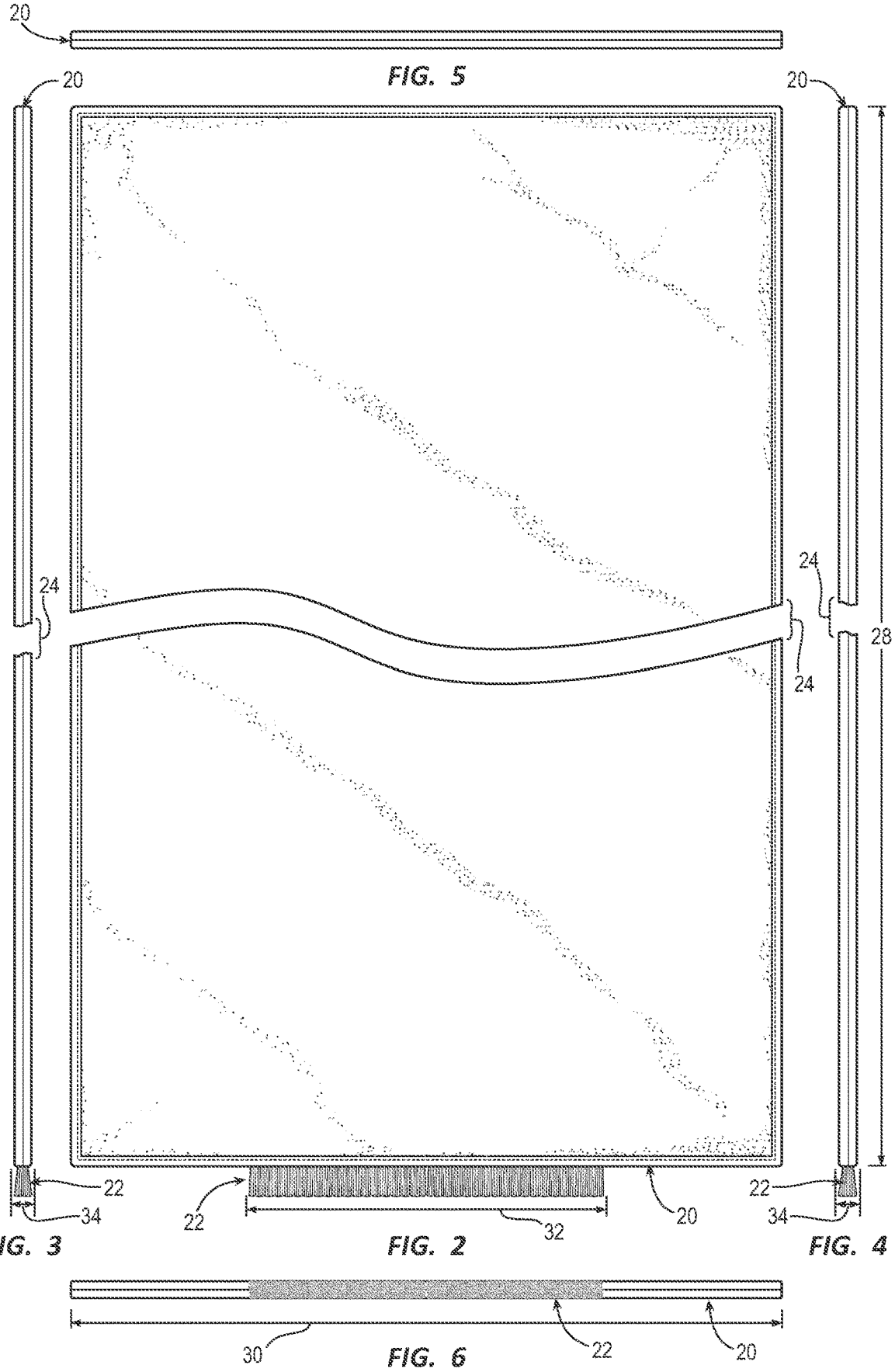
FIG. 2 is a top-down view of the brush towel.
FIG. 3 is a left side elevation view of the brush towel.
FIG. 4 is a right side elevation view of the brush towel.
FIG. 5 is a rear elevation view of the brush towel.
FIG. 6 is a front elevation view of the brush towel.
Figure 7:
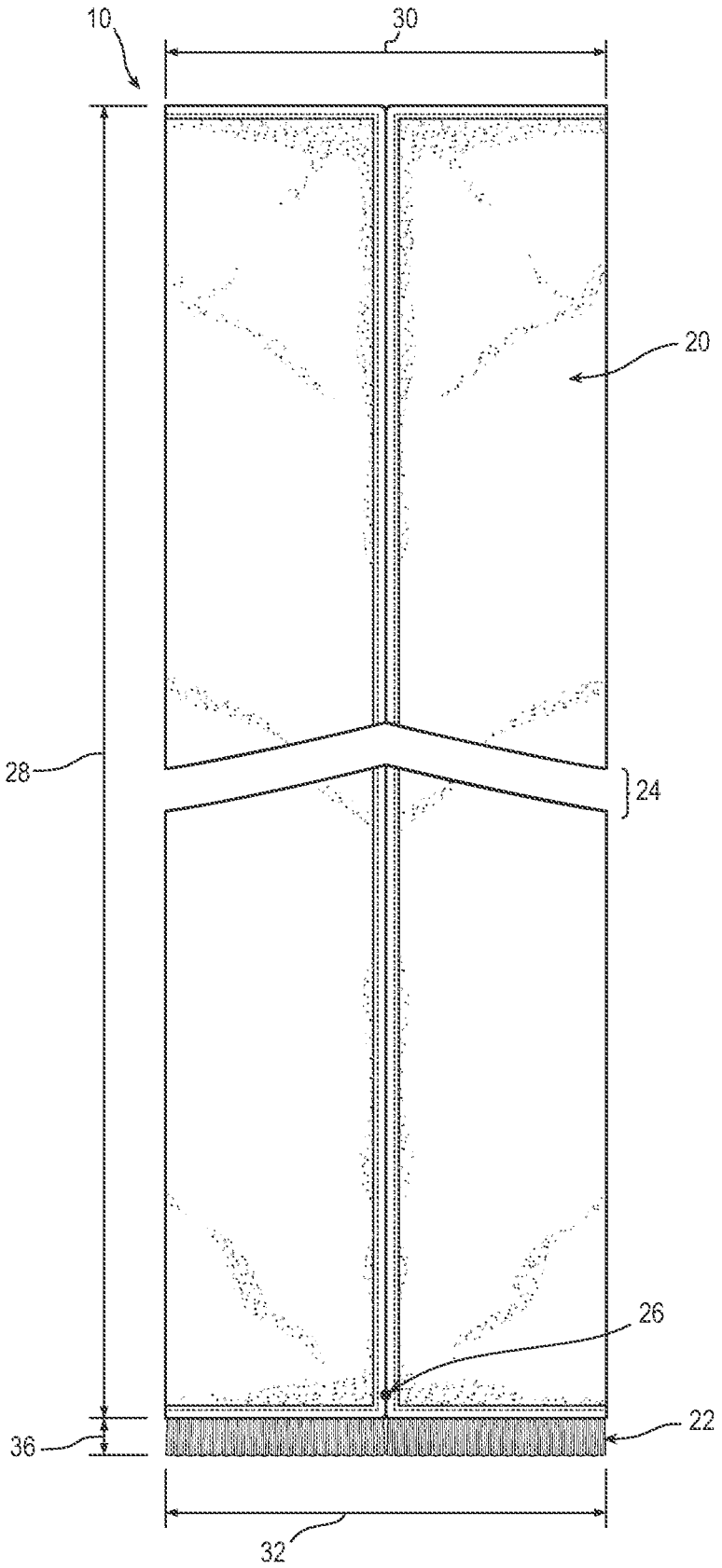
FIG. 7 is a top-down view of the brush towel in a flat, tri-folded state.

The towel 20 is made from a flexible fabric material and may be folded, or otherwise deformed, in a latitudinal dimension and/or longitudinal dimension. For example, the towel 20 may be folded in a latitudinal dimension at any point along the length of the towel, such as a midpoint 24 of the towel. The towel 20 may be folded in a longitudinal dimension, as shown in FIG. 7. Additionally, the towel 20 may be folded more than once in the latitudinal dimension and/or longitudinal dimension. For example, as shown in FIG. 7, the towel 20 may have a tri-fold structure in which the towel is folded twice in the longitudinal dimension.

In some embodiments, the towel 20 may be folded into a tri-fold structure, as shown in FIG. 7, and the fold may be secured at a meeting point 26 at the end of the towel near the integrated brush 22. The fold may be secured by any means readily known to those of ordinary skill in the art. By way of example, the fold may be secured by sewing or gluing together the ends of the towel 20 where they come together at meeting point 26.

In some embodiments, the towel 20 is made of a flexible, absorbent fabric material, designed to absorb and retain water for cleaning an article of sports equipment. In some embodiments, the absorbent fabric material is selected from the group consisting of microfiber fabric, cotton fabric, bamboo fabric, hemp fabric, modal fabric, and rayon fabric. In some embodiments, the absorbent fabric material is cotton fabric. In some embodiments, the absorbent fabric material is 100% cotton fabric. In other embodiments, the absorbent fabric material is 96% cotton fabric. In some embodiments, the absorbent fabric material is microfiber fabric. In one embodiment, the absorbent fabric material is a waffle-weave microfiber fabric. In some embodiments, the absorbent fabric material is a blend of microfiber fabric and cotton fabric.

Those of ordinary skill in the art will appreciate that the shape and size of the towel 20 may vary and may be any shape or size that is appropriate for cleaning an article of sports equipment. For example, the towel 20 may have a first side 28 and a second side 30, wherein the first side is longer in length than the second side, i.e. the towel 20 may be rectangular in shape. Alternatively, the towel 20 may have a first side and a second side, wherein the first side is equal in length to the second side, i.e. the towel 20 may be square in shape. In some embodiments, the length of the first side 28 is about 10 inches to about 35 inches, and length of the second side 30 is about 6 inches to about 25 inches. In one embodiment, the length of the first side 28 is about 25 inches and the length of the second side 30 is about 16 inches. In another embodiment, the length of the first side 28 is about 24 inches and the length of the second side 30 is about 16 inches.

The integrated brush 22 has a number of bristles, where the bristles of the integrated brush can be made of a variety of materials including wire, a synthetic material, or combinations thereof. For example, in some embodiments, the integrated brush 22 may have bristles made exclusively of wire. In other embodiments, the integrated brush 22 may have bristles that are made exclusively of a synthetic material. In yet other embodiments, the integrated brush 22 may have some bristles that are made of wire, and some bristles that are made of synthetic materials.

Those of ordinary skill in the art will appreciate that the wire bristles of the integrated brush 22 may be made of any metallic material that is appropriate for cleaning an article of sports equipment. For example, the wire bristles may be made of a metal selected from, but not limited to, steel wire, brass wire, bronze wire, and copper wire. In some embodiments of the brush towel 10, the integrated brush 22 includes wire bristles that are selected from steel wire, brass wire, bronze wire, and copper wire.

Those of ordinary skill in the art will also appreciate that the synthetic material bristles of the integrated brush 22 may be made of any synthetic material that is appropriate for cleaning an article of sports equipment. For example, the synthetic material bristles may be made of a synthetic material selected from, but not limited to, nylon, abrasive nylon, polystyrene, and polypropylene. In some embodiments of the brush towel 10, the integrated brush 22 includes bristles made of a synthetic material selected from nylon, abrasive nylon, polystyrene, and polypropylene. In other embodiments, the integrated brush 22 includes bristles made of a synthetic material selected from nylon, abrasive nylon, and polypropylene. In one embodiment, the synthetic material is nylon. In one embodiment, the synthetic material is abrasive nylon. In one embodiment, the synthetic material is polypropylene.

The integrated brush 22 may be durably attached to the towel 20 along any edge of the towel. For example, in some embodiments, the integrated brush 22 may be durably attached to the towel 20 along an edge of the first side 28 of the towel. In other embodiments, the integrated brush 22 may be durably attached to the towel 20 along an edge of the second side 30 of the towel. In some embodiments, the integrated brush 22 is durably attached to the towel 20 along an edge of the towel, such that the integrated brush 22 defines at least a portion of at least one side of the towel 20, as shown in FIGS. 1 through 8. In one embodiment, the integrated brush 22 is durably attached to the towel 20 along an edge of the first side 28 of the towel, such that at least a portion of the first side 28 of the towel is defined by the integrated brush 22. In another embodiment, the integrated brush 22 is durably attached to the towel 20 along an edge of the second side 30 of the towel, such that at least a portion of the second side 30 of the towel is defined by the integrated brush 22.

Those of ordinary skill in the art will appreciate that the integrated brush 22 may be durably attached to the towel 20 by any means appropriate to ensure that the integrated brush 22 is securely attached to the towel 20. For example, the integrated brush 22 may be durably attached to the towel 20 by sewing, gluing, riveting, stapling, and the like, or combinations thereof. In some embodiments, the integrated brush 22 may be sewn to the towel 20. In other embodiments, the integrated brush 22 may be glued to the towel 20. In one embodiment, the integrated brush 22 may be sewn and glued to the towel 20.

Those of ordinary skill in the art will also appreciate that the integrated brush 22 may be any size appropriate for cleaning an article of sports equipment. For example, in some embodiments, the integrated brush 22 may have a length 32 that is about 10% to about 100% of the length of the side 28/30 of the towel 20 to which the integrated brush 22 is durably attached. In some embodiments, the integrated brush 22 may have a length 32 that is about 30% to about 70% of the length of the side 28/30 of the towel 20 to which the integrated brush 22 is durably attached. In one embodiment, the integrated brush 22 may have a length 32 that is about 50% of the length of the side 28/30 of the towel 20 to which the integrated brush 22 is durably attached.

Likewise, the integrated brush 22 may have any thickness 34 appropriate for cleaning an article of sports equipment. For example, in some embodiments, the integrated brush 22 has a thickness 34 of about 1/16 inch to about 2 inches. In other embodiments, the integrated brush 22 has a thickness 34 of about ¼ inch to about 1 inch. In one embodiment, the integrated brush 22 has a thickness 34 of about ½ inch.

The bristles of the integrated brush 22 may also extend any length 36 from the edge of the towel 20 that is sufficient for cleaning an article of sports equipment. For example, in some embodiments, the bristles of the integrated brush 22 may extend a length 36 of about 1/16 inch to about 2 inches from the edge of the towel 20. In other embodiments, the bristles of the integrated brush 22 may extend a length 36 of about ¼ inch to about 1.5 inches from the edge of the towel 20. In one embodiment, the bristles of the integrated brush may extend a length 36 of about 1 inch from the edge of the towel 20.

Figure 8:
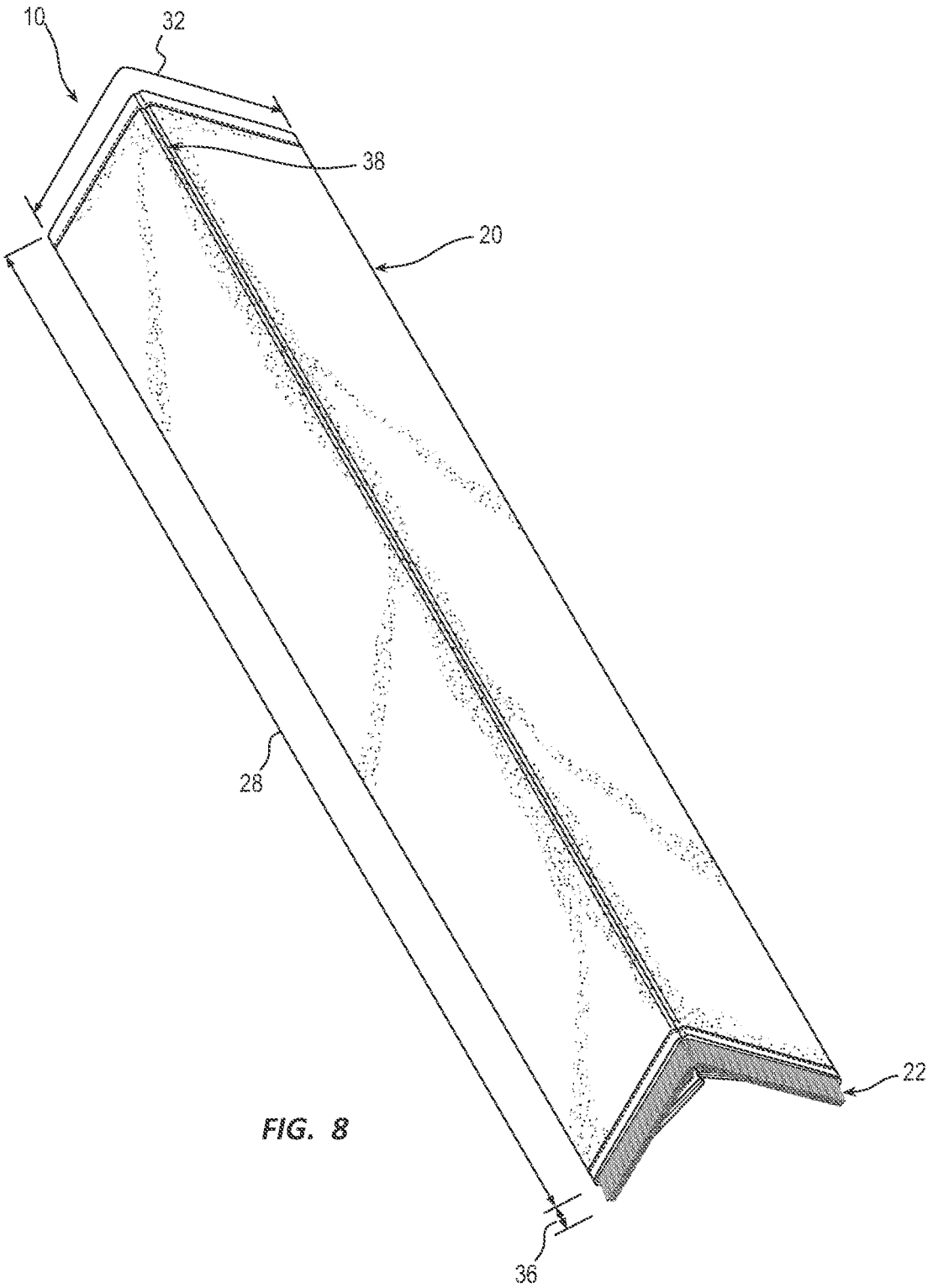
FIG. 8 is a left front perspective view of the brush towel in a peaked, tri-folded state.

The brush towel 10 includes an integrated brush 22, wherein the integrated brush 22 is configured to be foldable around a transverse axis 38 that runs through the towel 20 and perpendicularly intersects the integrated brush 22. The transverse axis 38 may be located at any lateral position along the towel 20, including at a midpoint of the towel 20, as shown in FIG. 8. Folding the integrated brush 22 increases the surface area of the integrated brush 22, thereby allowing a user to more directly apply force to a larger area of the equipment being cleaned. This shortens the cleaning time by reducing the amount of scrubbing necessary to clean the article. By way of example, the increased surface area of the integrated brush 22 in a folded state, as shown in FIG. 8, allows for the direct application of greater force to a larger surface area of the face of a golf club, reducing the amount of scrubbing necessary to clean the face of the golf club. Other articles of sports equipment that may be cleaned by the brush towel include, but are not limited to, golf balls and golf cleats.

The present disclosure also relates to methods of cleaning an article of sports equipment with the brush towel described herein. The methods include folding the integrated brush around a transverse axis that runs through the towel and scrubbing the article of sports equipment with the integrated brush. In some embodiments, the methods further include wiping residual debris from the article of sports equipment with the towel, wherein the towel may optionally be damp with water or another solvent useful for cleaning the article of sports equipment.

In some embodiments, the article of sports equipment to be cleaned is selected from a golf club, a golf ball, and golf cleats. In one embodiment, the article of sports equipment to be cleaned is a golf club. In another embodiment, the article of sports equipment to be cleaned is a golf ball. In yet another embodiment, the article of sports equipment to be cleaned is golf cleats.

The present disclosure enables one of skill in the relevant art to make and use the inventions provided herein in accordance with multiple and varied embodiments. Various alterations, modifications, and improvements of the present disclosure that readily occur to those skilled in the art, including certain alterations, modifications, substitutions, and improvements are also part of this disclosure. Accordingly, the foregoing description are by way of example to illustrate the discoveries provided herein. Furthermore, the foregoing Description is exemplary of the present invention and not limiting thereof. The scope of the invention is therefore set out in the appended claims.

STATEMENTS

1. An apparatus for cleaning sports equipment comprising: a towel having a first side and a second side; and an integrated brush comprising bristles, wherein the integrated brush is durably attached to the towel along an edge of the towel, and the bristles extend laterally away from the edge of the towel.
2. The apparatus of statement 1, wherein the bristles extend laterally away from the edge of the towel within a plane comprising the towel.
3. The apparatus of statements 1 or 2, wherein the integrated brush is durably attached to the towel along an edge of the first or second side of the towel, such that at least a portion of the first or second side of the towel is defined by the integrated brush.
4. The apparatus of any one of statements 1 to 3, wherein the towel comprises an absorbent fabric.
5. The apparatus of statement 4, wherein the absorbent fabric is selected from the group consisting of microfiber fabric, cotton fabric, bamboo fabric, hemp fabric, modal fabric, and rayon fabric.
6. The apparatus of any one of statements 1 to 5, wherein the towel comprises microfiber fabric.
7. The apparatus of any one of statements 1 to 6, wherein the bristles comprise wire, a synthetic material, or combinations thereof.
8. The apparatus of statement 7, wherein the wire is selected from the group consisting of stainless steel wire, brass wire, bronze wire, and copper wire, and the synthetic material is selected from nylon, abrasive nylon, polystyrene, and polypropylene.
9. The apparatus of any one of statements 1 to 8, wherein the bristles comprise a synthetic material selected from nylon, abrasive nylon, and polypropylene.
10. The apparatus of any one of statements 1 to 9, wherein the integrated brush is configured to be foldable around a transverse axis that runs through the towel, wherein the transverse axis is perpendicular to the integrated brush.
11. The apparatus of any one of statements 1 to 10, wherein the integrated brush has a length that is about 10% to about 100% of the length of the edge of the towel to which the integrated brush is durably attached.
12. The apparatus of any one of statements 1 to 11, wherein the integrated brush has a length that is about 50% of the length of the edge of the towel to which the integrated brush is durably attached.
13. The apparatus of any one of statements 1 to 12, wherein the integrated brush has a thickness of about ⅛ inch to about 1 inch.
14. The apparatus of any one of statements 1 to 13, wherein the integrated brush has a thickness of about ½ inch.
15. The apparatus of any one of statements 1 to 14, wherein a length of the first side is greater than a length of the second side.
16. The apparatus of any one of statements 1 to 15, wherein the first side has a length of about 10 inches to about 35 inches and the second side has a length of about 6 inches to about 25 inches.
17. The apparatus of any one of statements 1 to 16, wherein the first side has a length of about 25 inches and the second side has a length of about 16 inches.
18. The apparatus of any one of statements 15 to 17, wherein the integrated brush is durably attached along an edge of the towel located on the second side of the towel.
19. An apparatus for cleaning sports equipment comprising: a towel; and an integrated brush comprising bristles, wherein: the integrated brush is durably attached to the towel along an edge of the towel; the bristles extend laterally away from the edge of the towel within a plane comprising the towel; and the integrated brush is configured to be foldable around a transverse axis that runs through the towel, wherein the transverse axis is perpendicular to the integrated brush.
20. A method of cleaning an article of sports equipment with the apparatus of any one of statements 1 to 19 comprising: folding the integrated brush around a transverse axis that runs through the towel, wherein the transverse axis is perpendicular to the integrated brush; and scrubbing the article of sports equipment with the integrated brush.
21. The method of statement 20, wherein the method further comprises wiping residual debris from the article of sports equipment with the towel.

That which is claimed is:

1. An apparatus for cleaning sports equipment comprising:

a towel having a first side and a second side, the towel further comprising two longitudinal folds secured by a meeting point;

an integrated brush comprising bristles, wherein the integrated brush is durably attached to the towel along an edge of either the towel first side or the towel second side, the bristles extend laterally away from the edge of the towel; and the integrated brush is configured to be foldable around a transverse axis that runs through the towel and intersects the edge to which the integrated brush is attached.

2. The apparatus of claim 1, wherein the bristles extend laterally away from the edge of the towel within a plane comprising the towel.

3. The apparatus of claim 1, wherein the integrated brush is durably attached to the towel along an edge of the first or second side of the towel, such that at least a portion of the first or second side of the towel is defined by the integrated brush.

4. The apparatus of claim 1, wherein the towel comprises an absorbent fabric.

5. The apparatus of claim 4, wherein the absorbent fabric is selected from the group consisting of microfiber fabric, cotton fabric, bamboo fabric, hemp fabric, modal fabric, and rayon fabric.

6. The apparatus of claim 1, wherein the towel comprises microfiber fabric.

7. The apparatus of claim 1, wherein the bristles comprise wire, a synthetic material, or combinations thereof.

8. The apparatus of claim 7, wherein the wire is selected from the group consisting of stainless steel wire, brass wire, bronze wire, and copper wire, and the synthetic material is selected from nylon, abrasive nylon, polystyrene, and polypropylene.

9. The apparatus of claim 1, wherein the bristles comprise a synthetic material selected from nylon, abrasive nylon, and polypropylene.

10. The apparatus of claim 1, wherein the integrated brush has a length that is about 10% to about 100% of a length of the edge of the towel to which the integrated brush is durably attached.

11. The apparatus of claim 1, wherein the integrated brush has a length that is about 50% of a length of the edge of the towel to which the integrated brush is durably attached.

12. The apparatus of claim 1, wherein the integrated brush has a thickness of about ⅛ inch to about 1 inch.

13. The apparatus of claim 1, wherein the integrated brush has a thickness of about ½ inch.

14. The apparatus of claim 1, wherein a length of the first side is greater than a length of the second side.

15. The apparatus of claim 14, wherein the integrated brush comprises two segments foldable around the transverse axis.

16. The apparatus of claim 1, wherein the first side has a length of about 10 inches to about 35 inches and the second side has a length of about 6 inches to about 25 inches.

17. The apparatus of claim 1, wherein the first side has a length of about 25 inches and the second side has a length of about 16 inches.

18. A method of cleaning an article of sports equipment with the apparatus of claim 1 comprising:

folding the integrated brush around a transverse axis that runs through the towel, wherein the transverse axis is perpendicular to the integrated brush; and scrubbing the article of sports equipment with the integrated brush.

19. The method of claim 18, wherein the method further comprises wiping residual debris from the article of sports equipment with the towel.

20. An apparatus for cleaning sports equipment comprising:

a towel comprising at least two folds, the two folds securely connected at a meeting point; and an integrated brush comprising bristles, wherein:

the integrated brush is durably attached to the towel along an edge of the towel, the integrated brush comprising two segments;

the bristles extend laterally away from the edge of the towel within a plane comprising the towel; and wherein the two integrated brush segments are configured to be foldable around a transverse axis that runs through the towel, wherein the transverse axis is perpendicular to the integrated brush two segments.

21. A method of cleaning an article of sports equipment with the apparatus of claim 20 comprising:

folding the integrated brush around a transverse axis that runs through the towel, wherein the transverse axis is perpendicular to the integrated brush; and scrubbing the article of sports equipment with the integrated brush.

22. The method of claim 21, wherein the method further comprises wiping residual debris from the article of sports equipment with the towel.

* * * * *